US010453606B2

(12) United States Patent
Itoh et al.

(10) Patent No.: US 10,453,606 B2
(45) Date of Patent: Oct. 22, 2019

(54) MANUFACTURING METHOD OF TRANSFORMER DEVICE

(71) Applicant: FUJITSU LIMITED, Kawasaki-shi, Kanagawa (JP)

(72) Inventors: Masayuki Itoh, Kawasaki (JP); Hiroshi Kurosawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 208 days.

(21) Appl. No.: 15/348,628

(22) Filed: Nov. 10, 2016

(65) Prior Publication Data

US 2017/0062128 A1 Mar. 2, 2017

Related U.S. Application Data

(62) Division of application No. 14/257,095, filed on Apr. 21, 2014, now Pat. No. 9,524,819.

(30) Foreign Application Priority Data

May 17, 2013 (JP) ..... 2013-105192

(51) Int. Cl.
*H01F 41/064* (2016.01)
*H01F 27/02* (2006.01)
(Continued)

(52) U.S. Cl.
CPC ..... *H01F 41/064* (2016.01); *H01F 27/02* (2013.01); *H01F 27/06* (2013.01);
(Continued)

(58) Field of Classification Search
CPC ..... H01F 27/02; H01F 27/04; H01F 27/06; H01F 27/28; H01F 27/2823;
(Continued)

(56) References Cited

U.S. PATENT DOCUMENTS 5,226,220 A * 7/1993 Gevas ..... H01F 41/005 264/272.19
5,656,985 A 8/1997 Lu et al.
(Continued)

FOREIGN PATENT DOCUMENTS

JP 49-119747 U1 10/1974
JP 04-067308 U1 6/1992
(Continued)

OTHER PUBLICATIONS

Japanese Office Action Notification of Reasons for Refusal application No. 2013-105192 dated Feb. 14, 2017.

*Primary Examiner* — Peter Dungba Vo
*Assistant Examiner* — Joshua D Anderson
(74) *Attorney, Agent, or Firm* — Fujitsu Patent Center

(57) ABSTRACT

A transformer device includes: a transformer that includes a magnetic body core and a winding; a case that houses the transformer; an external terminal that is provided in the case; a relay section that is provided in the case and to which an end portion of the winding of the transformer is connected; and a conducting wire of which one end is wound around the external terminal and bonded thereto, and another end is connected to the relay section.

4 Claims, 9 Drawing Sheets

(51) Int. Cl.

| | |
|---|---|
| ***H01F 41/076*** | (2016.01) |
| ***H01F 41/10*** | (2006.01) |
| ***H01F 27/06*** | (2006.01) |
| ***H01F 27/28*** | (2006.01) |

(52) U.S. Cl.
CPC ..... *H01F 27/2828* (2013.01); *H01F 41/076* (2016.01); *H01F 41/10* (2013.01); *Y10T 29/49071* (2015.01)

(58) Field of Classification Search
CPC ..... H01F 27/2828; H01F 27/29; H01F 41/04; H01F 41/06; H01F 41/061; H01F 41/063; H01F 41/064; H01F 41/066; H01F 41/068; H01F 41/069; H01F 41/076; H01F 41/094; H01F 41/10; Y10T 29/4902; Y10T 29/49072; Y10T 29/49073
See application file for complete search history.

(56) References Cited

U.S. PATENT DOCUMENTS

| | | | | |
|---|---|---|---|---|
| 6,225,560 | B1 * | 5/2001 | Machado | H01F 27/027 174/535 |
| 7,028,387 | B1 | 4/2006 | Huynh et al. | |
| 8,866,576 | B2 * | 10/2014 | Park | H01F 27/2828 336/192 |
| 9,019,056 | B2 * | 4/2015 | An | H01F 5/04 336/192 |
| 2011/0095847 | A1 | 4/2011 | Chen et al. | |
| 2012/0309236 | A1 | 12/2012 | Purkis et al. | |

FOREIGN PATENT DOCUMENTS

| | | | |
|---|---|---|---|
| JP | 08-138939 | A | 5/1996 |
| JP | 11-243021 | A | 9/1999 |

* cited by examiner

MANUFACTURING METHOD OF TRANSFORMER DEVICE

CROSS-REFERENCE TO RELATED APPLICATION

This application is a divisional of U.S. application Ser. No. 14/257,095 filed on Apr. 21, 2014, which claims the benefit of priority of the Japanese Patent Application No. 2013-105192, filed on May 17, 2013, the entire contents of which are incorporated herein by reference herein.

FIELD

The embodiments discussed herein are related to a transformer device and a method for manufacturing the transformer device.

BACKGROUND

Since the past, a choke coil for a power supply circuit is known that is composed of a plate-shaped magnetic body core, a coil element that is wound around the magnetic body core, and two terminals that are formed on both end portions of a surface of the magnetic body core and respectively electrically connected to both ends of the coil element (for example, refer to Japanese Laid-open Patent Publication No. 11-243021). In the choke coil, a lead wire is connected to a terminal by high-temperature soldering, and the terminal is adhered to the surface of the magnetic body core by an electrically conductive adhesive such that the lead wire is interposed between the terminal and the magnetic body core.

When a winding of a transformer is connected to an external terminal, to increase the reliability of the connecting section, the winding of the transformer and the external terminal are sometimes bonded by a solder or the like after an end portion of the winding is wound around the external terminal. In such instances in which bonding which accompanies winding is performed, slack in the winding of the transformer is no longer present and tension is generated when the winding is wound around the external terminal.

When mounting of the transformer device is performed while the tension is still being generated, for example, during a reflow process, the winding of the transformer may become disconnected as a result of thermal contraction after thermal expansion of the winding of the transformer.

SUMMARY

According to an aspect of the invention, a transformer device includes: a transformer that includes a magnetic body core and a winding; a case that houses the transformer; an external terminal that is provided in the case; a relay section that is provided in the case and to which an end portion of the winding of the transformer is connected; and a conducting wire of which one end is wound around the external terminal and bonded thereto, and another end is connected to the relay section.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, embodiments will be described in detail with reference to the accompanying drawings.

Figure 1:
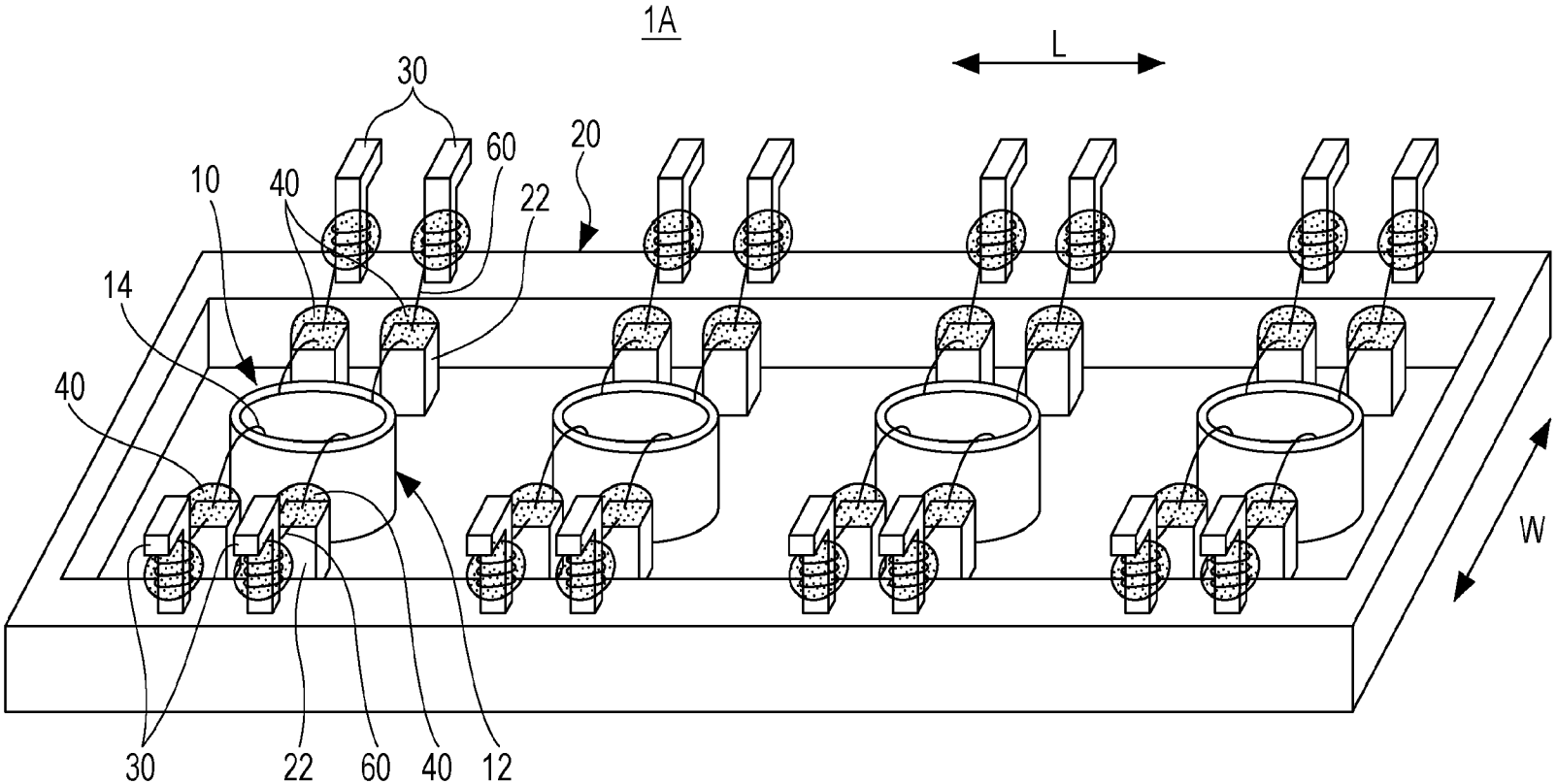
FIG. 1 is a perspective view schematically illustrating a transformer device 1A according to an embodiment (first embodiment)
Figure 2:
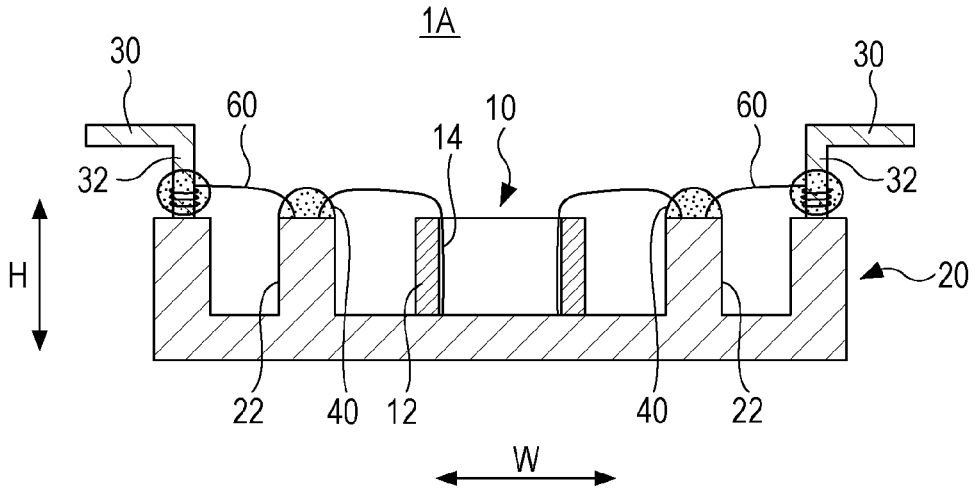
FIG. 2 is a schematic cross-sectional view of the transformer device 1A.

FIG. 1 is a perspective view schematically illustrating a transformer device 1A according to an embodiment (first embodiment). FIG. 2 is a schematic cross-sectional view of the transformer device 1A. FIG. 1 is a perspective view of a rear side of the transformer device 1A. In FIGS. 1 and 2, bonding sections bonded by a solder or an electrically conductive adhesive are illustrated in a semi-transparent manner by textured shading for convenience to allow the inside of the section to be known. In addition, in FIG. 2, a conducting wire 60 is illustrated schematically rather than cross-sectionally for convenience to facilitate understanding.

The transformer device 1A includes a transformer 10, a case 20, an external terminal 30, a relay section 40, and the conducting wire 60. In the example illustrated in FIG. 1, the transformer device 1A includes four transformers 10. However, the number of transformers 10 is arbitrary. In addition, the transformer device 1A may include electronic components other than the transformers 10. Hereafter, a single transformer 10 will basically be described as a representative. However, the description may similarly apply to the other transformers 10.

The transformer device 1A may be mounted on a substrate. In the example illustrated in FIG. 1, mounting of the transformer device 1A may be actualized by the external terminal 30 (section projecting from the case 20) being bonded by a solder or the like to a predetermined position on the substrate. Here, for convenience, directions related to front side and rear side are defined with the side opposing the substrate during mounting of the transformer device 1A as the rear side.

The transformer 10 includes a core 12 serving as a magnetic body core and a winding 14. The configuration of the transformer 10 is arbitrary. For example, the transformer 10 may be a toroidal transformer or an EI transformer. In the example illustrated in FIG. 1, the transformer 10 is a toroidal type, and the core 12 is ring-shaped. The winding 14 may be composed of a copper wire, for example. The winding 14 may include two windings (primary winding and secondary winding) for a single transformer 10. Hereafter, a single winding 14 will basically be described as a representative. However, the description may similarly apply to the other windings 14.

The winding 14 includes a wound portion that is wound around the core 12, and a non-wound portion that is not wound around the core 12 and is used to connect to the external terminal 30 (with the relay section 40, described hereafter, therebetween). Hereafter, unless specifically stated, the term "winding 14" is used with no distinction between the wound portion and the non-wound portion. For example, an end portion of the winding 14 in the description hereafter corresponds with an end portion of the non-wound portion of the winding 14.

The case 20 houses the transformer 10. The case 20 may be composed of an arbitrary insulating material. The case 20 may be formed by resin molding, for example.

The external terminal 30 is provided in the case 20. As illustrated in FIG. 1, a plurality of external terminals 30 may be provided in correspondence to the number of terminals in the transformer device 1A. Hereafter, a single external terminal 30 will basically be described as a representative. However, the description may similarly apply to the other external terminals 30. The external terminal 30 may be provided in an arbitrary manner in the case 20. In the example illustrated in FIG. 1, the transformer device 1A is in the form of a surface-mounted semiconductor component, in which the external terminal 30 is provided in an end portion of the case 20 in a width direction W such as to project from the rear side of the case 20. The external terminal 30 may be provided to connect an electronic component (such as the transformer 10) within the transformer device 1A to an external electronic device (such as a power supply).

The external terminal 30 may have an arbitrary form. However, the external terminal 30 has a portion (such as portion 32 illustrated in FIG. 2) that is suitable for winding of an end portion of the conducting wire 60, as described hereafter. In the example illustrated in FIG. 1, the external terminal 30 is bar-shaped, and an end portion (portion projecting from the rear side of the case 20) is bent in the width direction W such as to extend within a horizontal plane. The external terminal 30 may be formed by a lead frame or the like. The external terminal 30 may be integrated (insert-molded) with the case 20 by resin molding.

The relay section 40 is provided in the case 20. As illustrated in FIG. 1, the relay section 40 may form a pair with a single external terminal 30. A number of relay sections 40 corresponding to the number of external terminals 30 may be provided. Hereafter, a single relay section 40 will basically be described as a representative. However, the description may similarly apply to the other relay sections 40. The relay section 40 provides a function (described hereafter) of relaying electrical connection between the external terminal 30 and the transformer 10. The relay section 40 may be provided in an arbitrary area within the case 20. The relay section 40 is preferably disposed between the external terminal 30 and the transformer 10 to minimize spatial distance for electrically connecting the external terminal 30 and the transformer 10. An end portion of the winding 14 and an end portion of the conducting wire 60 are connected to the relay section 40.

The relay section 40 establishes (relays) electrical connection between the external terminal 30 and the transformer 10 by electrically connecting the end portion of the winding 14 and the end portion of the conducting wire 60 that are physically separated from each other. For example, the relay section 40 may be formed by an electrically conductive adhesive or a solder. In the relay section 40, the end portion of the winding 14 and the end portion of the conducting wire 60 may be in direct contact with each other. Alternatively, the end portion of the winding 14 and the end portion of the conducting wire 60 may be apart from each other to ensure slack that may be desired in the winding 14 and the conducting wire 60. In instances in which the end portion of the winding 14 and the end portion of the conducting wire 60 are apart from each other, the distance between the end portion of the winding 14 and the end portion of the conducting wire 60 (separation distance) may be decided based on the amounts of slack (surplus length) that may be desired in the winding 14 and the conducting wire 60. At this time, the amounts of slack that may be desired may be decided by taking into consideration respective thermal contraction states of the winding 14 and the conducting wire 60 during a mounting process of the transformer device 1A.

In the examples illustrated in FIGS. 1 and 2, the relay section 40 is formed by an electrically conductive adhesive applied to a base 22. In other words, the end portion of the winding 14 and the end portion of the conducting wire 60 are bonded to the base 22 by the electrically conductive adhesive. At this time, to ensure the slack that may be desired, the end portion of the winding 14 and the end portion of the conducting wire 60 are preferably separated from each other in the width direction W. In the examples illustrated in FIGS. 1 and 2, the base 22 is formed in the case 20 in a position corresponding to the relay section 40. The base 22 may be formed integrally with the case 20. Alternatively, the base 22 may be formed separately from the case 20 and fixed to the case 20. The material for the electrically conductive adhesive is arbitrary but preferably has characteristics such that the material does not melt in a high-temperature environment that may occur during the mounting process (such as during the reflow process). For example, Pyro-Duct 597-A, 597-C, and the like, manufactured by Aremco Products Inc., are suitable as the electrically conductive adhesive. Pyro-Duct 597-A and 597-C have a heat-resistance upper limit of 927° C. and are capable of being used for adhesion of electronic components and high-vacuum components.

The conducting wire 60 may be composed of a copper wire, for example. One end of the conducting wire 60 is wound around the external terminal 30 and bonded thereto. The other end of the conducting wire 60 is connected to the relay section 40, as described above. As illustrated in FIG. 1, the conducting wire 60 may form a pair with a single set of external terminal 30 and relay section 40. A number of conducting wires 60 corresponding to the number of external terminals 30 may be provided. Hereafter, a single conducting wire 60 will basically be described as a representative. However, the description may similarly apply to the other conducting wires 60. The conducting wire 60 may be wound around and bonded to an arbitrary portion of the external terminal 30. In the example illustrated in FIG. 2, the conducting wire 60 is wound around the portion 32 of the external terminal 30 that extends in an up/down direction and bonded thereto. Bonding of the conducting wire 60 to the external terminal 30 may be actualized by an electrically conductive adhesive or a solder. Bonding by the electrically conductive adhesive or solder is preferably performed on the overall winding portion of the conducting wire 60. However, bonding may be performed on a portion of the winding portion of the conducting wire 60. The electrically conductive adhesive or solder may be applied after the conducting wire 60 is wound. Alternatively, the electrically conductive adhesive or solder may be applied to the external terminal 30 before the conducting wire 60 is wound or during the winding of the conducting wire 60. In addition, the number of times the conducting wire 60 is wound (the number of turns of the conducting wire 60 around the external terminal 30) is arbitrary. However, to enhance reliability of the connecting section (bonding section) between the external terminal 30 and the conducting wire 60, the conducting wire 60 is preferably wound once or more (in other words, the conducting wire 60 makes one turn or more). A reason for this is that, particularly when the conducting wire 60 is bonded to the external terminal 30 by a solder, the solder in the bonding section melts during the mounting process (such as during the reflow process). As a result of the conducting wire 60 being wound around the external terminal 30, the conducting wire 60 does not easily detach from the external terminal 30 even when the solder temporarily melts during the reflow process, for example.

Figure 3:
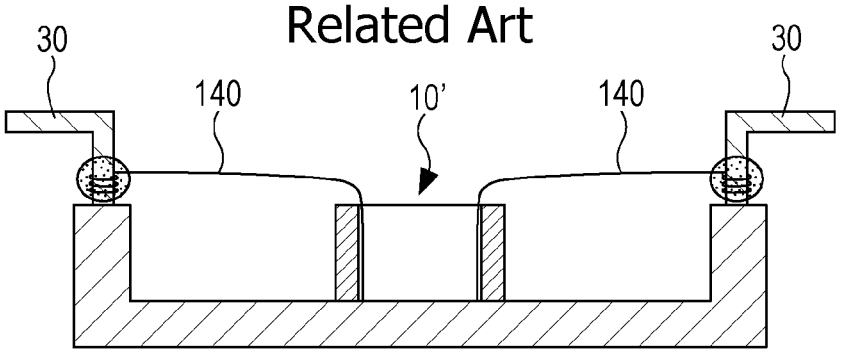
FIG. 3 Related Art
FIG. 3 is a cross-sectional view of a transformer device in a comparison example.

FIG. 3 is a cross-sectional view of a transformer device in a comparison example. In the comparison example illustrated in FIG. 3, a winding 140 of a transformer 10' is directly wound around the external terminal 30 and then bonded thereto. In the comparison example such as this, when the winding 140 of the transformer 10' is wound around the external terminal 30, slack in the winding 140 of the transformer 10' is no longer present. In other words, the winding 140 of the transformer 10' is wound around the external terminal 30 without slack, while pulling the winding 140 of the transformer 10' in a wind-out direction. Therefore, tension is generated in the winding 140 of the transformer 10' in accordance with the winding. When a transformer device is mounted on a substrate in a state in which the tension is being generated, for example, when the winding 140 of the transformer 10' thermally contracts after thermal expansion during the reflow process, the tension in the winding 140 of the transformer 10' further increases. Disconnection of the winding 140 of the transformer 10' may occur. Disconnection of the winding 140 of the transformer 10' typically occurs at the bonding section between the winding 140 of the transformer 10' and the external terminal 30, but may also occur in other areas.

Conversely, in the transformer device 1A according to the present embodiment, as described above, the winding 14 of the transformer 10 is not directly wound around the external terminal 30 and bonded thereto. Rather, the winding 14 of the transformer 10 is connected to the external terminal 30 with the conducting wire 60 and the relay section 40 therebetween. Therefore, the winding 14 of the transformer 10 may be connected to the relay section 40 in a state in which slack is maintained. Consequently, tension in the winding 14 of the transformer 10 is reduced. As a result, disconnection of the winding 14 of the transformer 10 may be reduced even when the winding 14 of the transformer 10 thermally contracts (after thermal expansion) during the mounting process of the transformer device 1A (such as during the reflow process in the mounting process). In addition, the conducting wire 60 may also be connected to the relay section 40 in a state in which slack is maintained. Consequently, tension in the conducting wire 60 is reduced. Therefore, disconnection of the conducting wire 60 may be reduced even when the conducting wire 60 thermally contracts (after thermal expansion) during the mounting process of the transformer device 1A.

In addition, when the relay section 40 is formed by an electrically conductive adhesive, the relay section 40 itself has elasticity attributed to the elastic characteristics of the electrically conductive adhesive. Therefore, even when the winding 14 of the transformer 10 or the conducting wire 60 thermally contracts during the reflow process, for example, the relay section 40 elastically deforms, thereby relaxing the tension in the winding 14 of the transformer 10 and the conducting wire 60 at the relay section 40. As a result, the possibility of disconnection of the winding 14 of the transformer 10 and disconnection of the conducting wire 60 caused by thermal contraction may be further reduced.

In addition, when the relay section 40 is formed by the electrically conductive adhesive, melting of the relay section 40 as a result of heat (such as heat during the reflow process) is less likely to occur compared to when the relay section 40 is formed by a solder. Therefore, when the relay section 40 is formed by the electrically conductive adhesive, reliability of the bonding section between the winding 14 of the transformer 10 and the conducting wire 60 at the relay section 40 may be enhanced compared to when the relay section 40 is formed by a solder.

In the example illustrated in FIG. 1, the base 22 is formed for each external terminal 30. However, the base 22 may be formed such as to be shared among the plurality of external terminals 30. This configuration is particularly suitable in instances in which distance between relay sections 40 that are adjacent to each other in a longitudinal direction L is able to be sufficiently ensured, in instances in which the viscosity of the electrically conductive adhesive that is capable of being used to form the relay section 40 is high, and the like. A reason for this is that, in these instances, electrical insulation between the relay sections 40 that are adjacent in the longitudinal direction L may be easily ensured, even when the base 22 is shared.

According to the present embodiment, the conducting wire 60 may be provided separately from the winding 14 of the transformer 10. Alternatively, the conducting wire 60 may be formed from a portion of a conducting wire forming the winding 14 of the transformer 10. In other words, the conducting wire 60 may be an extending portion of the winding 14 of the transformer 10 that is severed at the end portion (end portion connected to the relay section 40) of the winding 14 of the transformer 10 and detached from the winding 14 of the transformer 10 (see FIGS. 4A to 4C and 5A to 5C).

Next, an example of a method for manufacturing the transformer device 1A will be described with reference to FIGS. 4A to 4C and 5A to 5C.

Figure 4A:
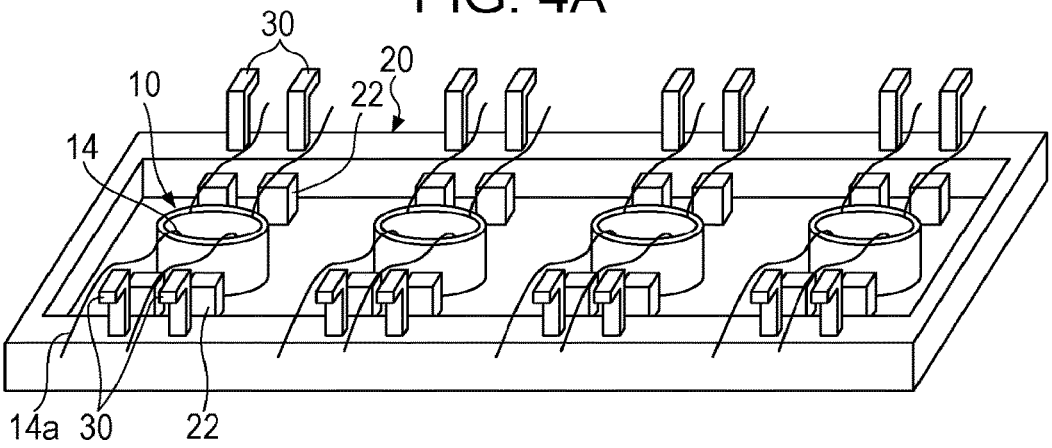
FIGS. 4A to 4C are an explanatory diagram (1) of an example of a method for manufacturing the transformer device 1A.
Figure 4B:
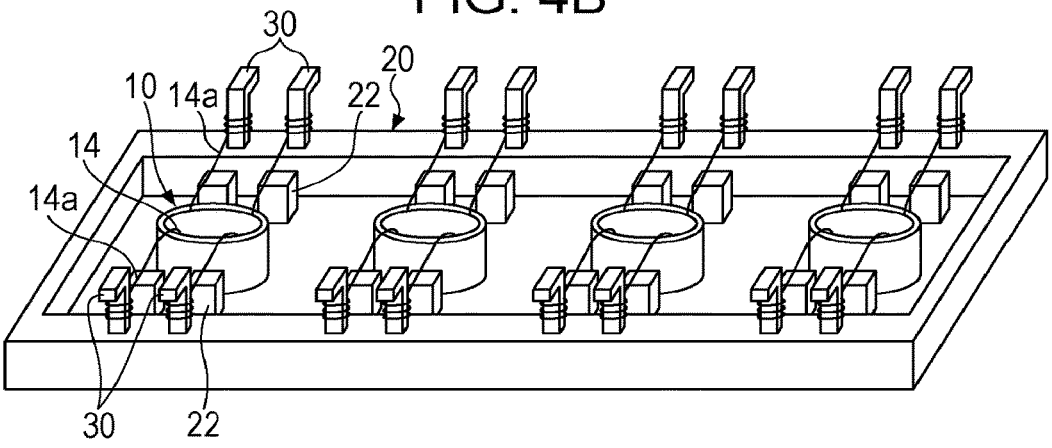
Figure 4C:
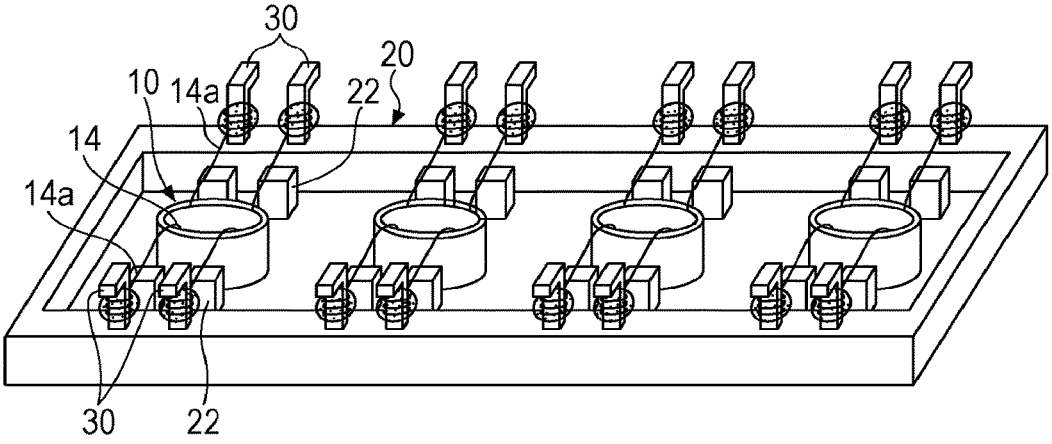
Figure 5A:
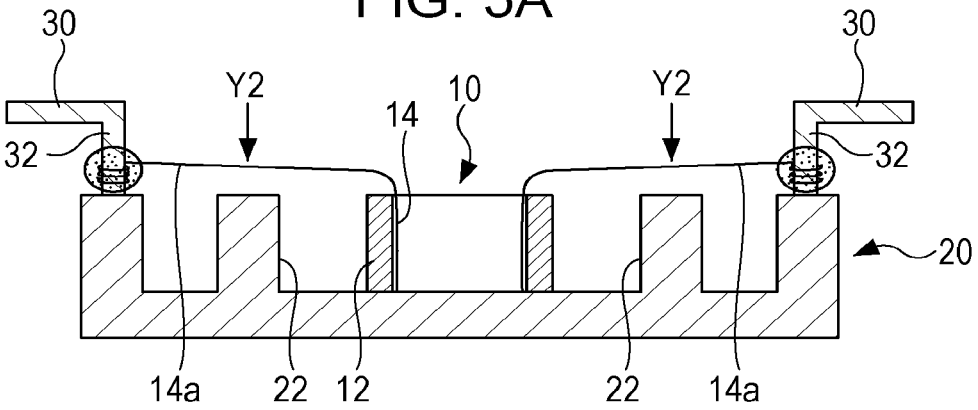
FIGS. 5A to 5C are an explanatory diagram (2) of the example of the method for manufacturing the transformer device 1A.
Figure 5B:
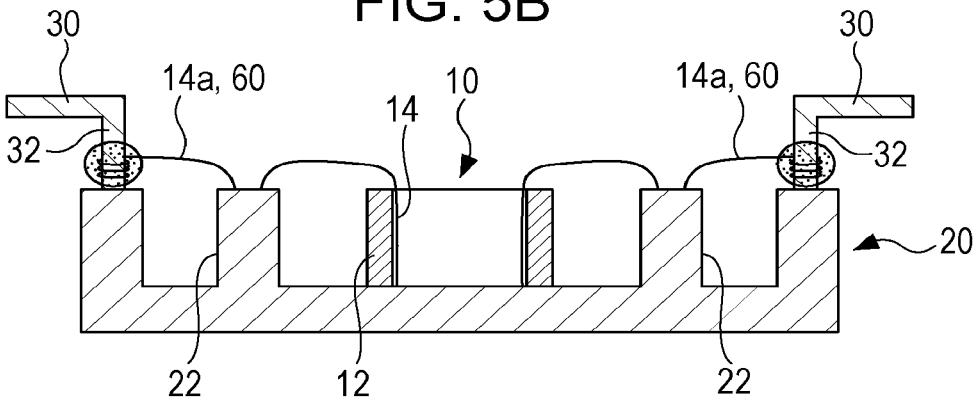
Figure 5C:
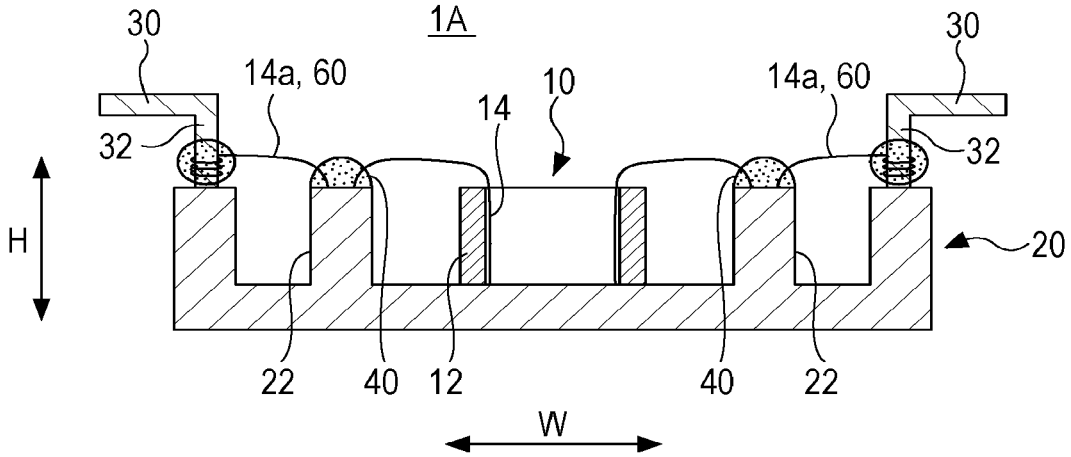

FIGS. 4A to 4C and 5A to 5C are explanatory diagrams of an example of a method for manufacturing the transformer device 1A. FIGS. 4A to 4C are schematic perspective views corresponding to FIG. 1. FIGS. 5A to 5C are schematic cross-sectional views corresponding to FIG. 2.

First, as illustrated in FIG. 4A, the case 20 including the external terminal 30 is prepared. The transformer 10 is disposed in a predetermined position within the case 20. At this time, the transformer 10 may be fixed to the case 20 by a varnish or the like. At this stage, an extending portion 14*a* of the winding 14 of the transformer 10 is in a free state.

Next, as illustrated in FIG. 4B, the extending portion 14*a* of the winding 14 of the transformer 10 is wound around the external terminal 30. At this time, the winding 14 of the transformer 10 may be pulled in the wind-out direction and wound around the external terminal 30. The number of turns may be arbitrary, as described above.

Next, as illustrated in FIG. 4C, the end portion (portion wound around the external terminal 30) of the extending portion 14*a* of the winding 14 of the transformer 10 is bonded to the external terminal 30. Bonding may be actualized by an electrically conductive adhesive or a solder, as described above.

Next, the winding 14 of the transformer 10 is severed with the severing point as schematically indicated by Y2 in FIG. 5A, and the extending portion 14*a* of the winding 14 is detached. As a result, as illustrated in FIG. 5B, the extending portion 14*a* of the winding 14 of the transformer 10 is detached from the winding 14 (main portion) of the transformer 10 and forms the conducting wire 60.

Next, as illustrated in FIG. 5C, the end portion (end portion on the side opposite to the end portion on the side bonded to the external terminal 30) of the conducting wire 60 (extending portion 14*a*) and the end portion of the winding 14 of the transformer 10 from which the extending portion 14*a* has been detached are bonded to the base 22 by an electrically conductive adhesive or a solder. As a result, the relay section 40 is formed by the electrically conductive adhesive or the solder, and connection of the end portion of the extending portion 14*a* and the end portion of the winding 14 of the transformer 10 to the relay section 40 is actualized. Bonding of the end portion of the extending portion 14*a* and bonding of the end portion of the winding 14 of the transformer 10 may be performed simultaneously or with a time lag. When bonding is performed with a time lag, for example, after the end portion of the extending portion 14*a* is bonded to the base 22 by the electrically conductive adhesive or the solder, the end portion of the winding 14 of the transformer 10 may be bonded by the electrically conductive adhesive or the solder such as to be electrically connected to the bonding section.

According to the method for manufacturing the transformer device 1A illustrated in FIGS. 4A to 4C and 5A to 5C, the state illustrated in FIG. 5A is similar to the state of the comparison example illustrated in FIG. 3. In other words, when the extending portion 14*a* of the winding 14 of the transformer 10 is wound around the external terminal 30, slack in the winding 14 of the transformer 10 is reduced, and tension is generated in the winding 14 of the transformer 10. However, in the method for manufacturing the transformer device 1A illustrated in FIGS. 5A to 5C, in the state illustrated in FIG. 5A, the extending portion 14*a* of the winding 14 of the transformer 10 is severed. The end portion of the severed extending portion 14*a* and the end portion of the winding 14 of the transformer 10 are individually connected to the relay section 40. At this time, connection of the end portion of the winding 14 of the transformer 10 to the relay section 40 is actualized by bonding to the base 22 that does not accompany winding. Therefore, the winding 14 of the transformer 10 may be connected to the relay section 40 with suitable surplus length. As a result, tension in the winding 14 of the transformer 10 may be reduced. In addition, in a similar manner, connection of the end portion of the extending portion 14*a* to the relay section 40 is actualized by bonding to the base 22 that does not accompany winding. Therefore, the conducting wire 60 (extending portion 14*a*) may be connected to the relay section 40 with suitable surplus length. As a result, tension in the conducting wire 60 may be reduced. Consequently, disconnection of the winding 14 of the transformer 10 and the conducting wire 60 attributed to thermal contraction occurring during the mounting process of the transformer device 1A may be reduced. The distance (separation distance in the width direction W) between the end portion of the conducting wire 60 and the end portion of the winding 14 of the transformer 10 in the relay section 40 and the accompanying length (length in the width direction W) of the relay section 40 may be decided based on the surplus lengths that may be desired in the winding 14 of the transformer 10 and the conducting wire 60. In addition, to efficiently obtain the surplus lengths in the winding 14 of the transformer 10 and the conducting wire 60, the position of the base 22 in a height direction H is preferably set to be substantially the same as the position of the winding portion of the conducting wire 60 in the height direction H.

Figure 6A:
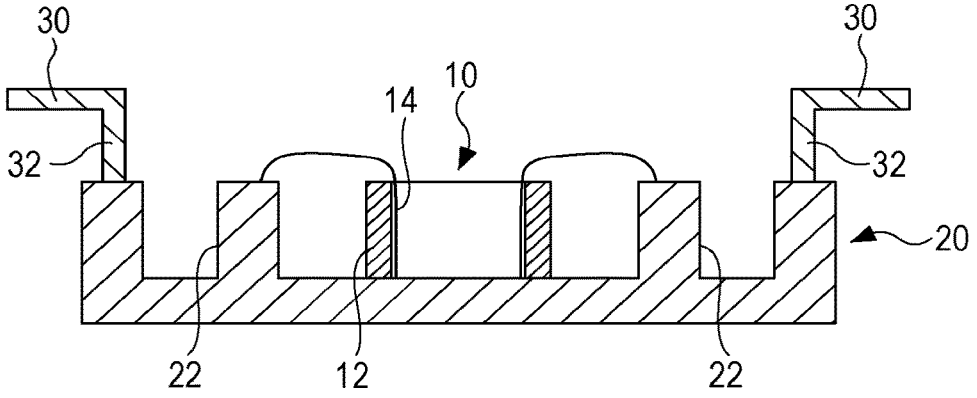
FIGS. 6A to 6C are an explanatory diagram of another example of the method for manufacturing the transformer device 1A.
Figure 6B:
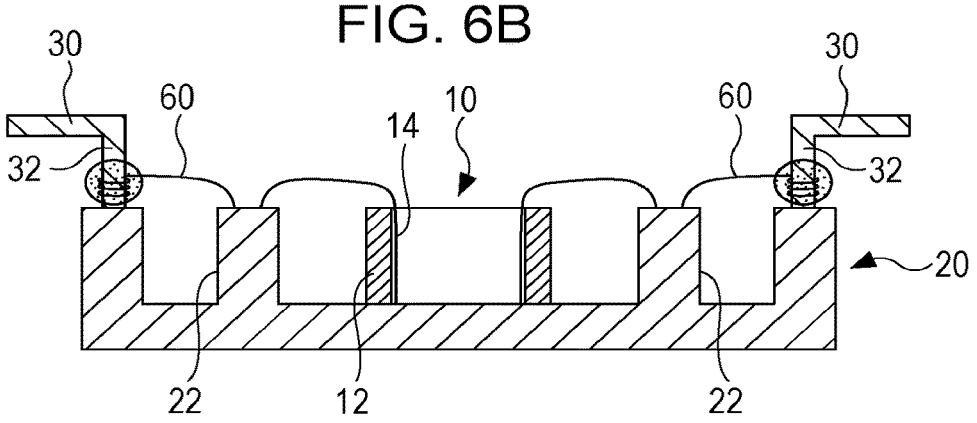
Figure 6C:
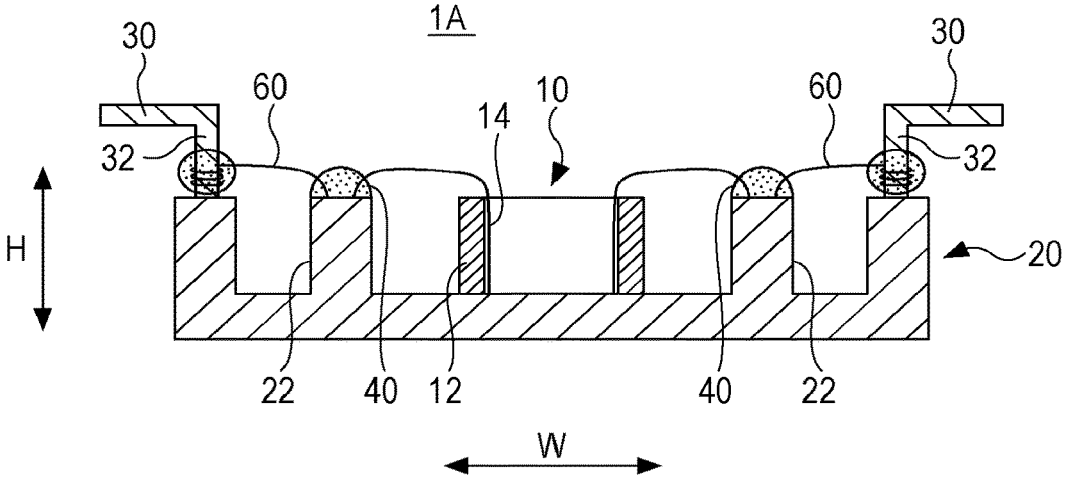

FIGS. 6A to 6C are an explanatory diagram of another example of the method for manufacturing the transformer device 1A, and are schematic cross-sectional views corresponding to FIG. 2.

In the present example, in a manner similar to the above-described example illustrated in FIGS. 4A to 4C and 5A to 5C, the case 20 including the external terminal 30 is prepared. As illustrated in FIG. 6A, the transformer 10 is disposed in a predetermined position within the case 20. However, in the present example, the winding 14 of the transformer 10 does not include the extending portion 14*a*.

Next, the conducting wire 60 is prepared. As illustrated in FIG. 6B, one end of the conducting wire 60 is wound around the external terminal 30 and bonded thereto. Bonding may be actualized by an electrically conductive adhesive or a solder, as described above.

Next, the other end of the conducting wire 60 and the end portion of the winding 14 of the transformer 10 are bonded to the base 22 by an electrically conductive adhesive or a solder. As a result, the relay section 40 is formed by the electrically conductive adhesive or the solder, and connection of the other end of the conducting wire 60 and the end portion of the winding 14 of the transformer 10 to the relay section 40 is actualized. In a similar manner, bonding of the end portion of the conducting wire 60 and bonding of the end portion of the winding 14 of the transformer 10 may be performed simultaneously or with a time lag.

According to the method for manufacturing the transformer device 1A illustrated in FIGS. 6A to 6C, the end portion of the conducting wire 60 and the end portion of the winding 14 of the transformer 10 are individually connected to the relay section 40. Therefore, the winding 14 of the transformer 10 may be connected to the relay section 40 with suitable surplus length, and tension in the winding 14 of the transformer 10 may be reduced. In a similar manner, the conducting wire 60 may be connected to the relay section 40 with suitable surplus length, and tension in the conducting wire 60 may be reduced. Consequently, disconnection of the winding 14 of the transformer 10 and the conducting wire 60 attributed to thermal contraction occurring during the mounting process of the transformer device 1A may be reduced.

The method for manufacturing the transformer device 1A illustrated in FIGS. 6A to 6C is capable of more easily ensuring the surplus lengths of the winding 14 of the transformer 10 and the conducting wire 60, compared to the above-described manufacturing method illustrated in FIGS. 4A to 4C and 5A to 5C. Therefore, when the method for manufacturing the transformer device 1A illustrated in FIGS. 6A to 6C is used, the position of the base 22 in the height direction H is arbitrary. The base 22 may even be ultimately omitted. For example, if the base 22 is omitted, the relay section 40 may be formed on the surface of the case 20 on which the transformer 10 is placed.

Figure 7:
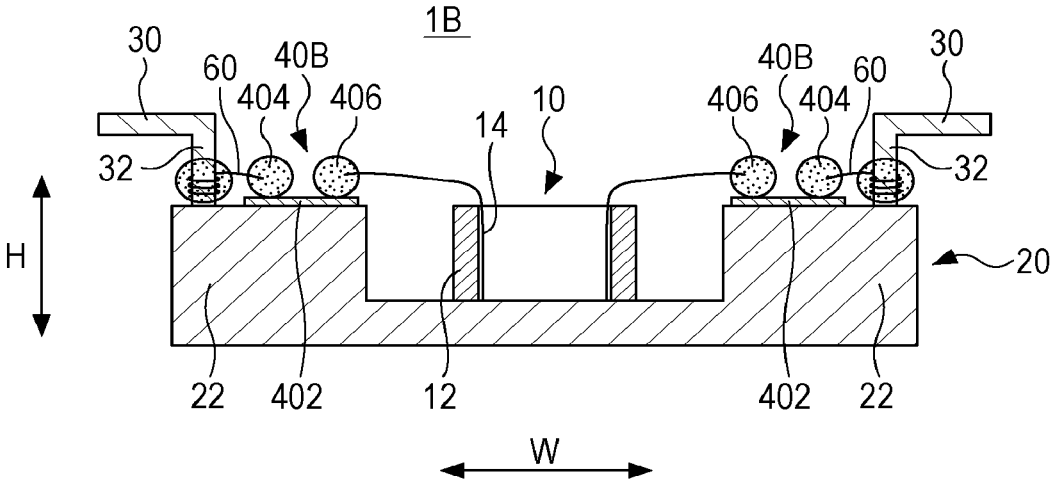
FIG. 7 is a cross-sectional view schematically illustrating a transformer device 1B according to another embodiment (second embodiment)

FIG. 7 is a cross-sectional view schematically illustrating a transformer device 1B according to another embodiment (second embodiment).

In the transformer device 1B, the configuration of a relay section 40B mainly differs from that of the relay section 40 of the transformer device 1A, described above. Hereafter, configurations differing from those of the above-described transformer device 1A will mainly be described. Other configurations may be similar to those of the above-described transformer device 1A.

The relay section 40B includes a conductor layer 402, a first bonding section 404, and a second bonding section 406.

The conductor layer 402 may be formed by an electrically conductive adhesive or a solder. For example, the conductor layer 402 may be formed by the electrically conductive adhesive being applied to the base 22. In addition, for example, the conductor layer 402 may be formed by an electrically conductive ink being printed on the base 22 by a screen printing method or an inkjet printing method. Moreover, the conductor layer 402 may be formed by a metal plate that is integrated with the case 20, in a manner similar to the external terminal 30.

In a similar manner, the first bonding section 404 may be formed by an electrically conductive adhesive or a solder. The first bonding section 404 bonds the end portion of the conducting wire 60 to the conductor layer 402 on the base 22 such that the conductor wire 60 is electrically connected to the conductor layer 402.

In a similar manner, the second bonding section 406 may be formed by an electrically conductive adhesive or a solder. The second bonding section 406 bonds the end portion of the winding 14 of the transformer 10 to the conductor layer 402 on the base 22 such that the winding 14 of the transformer 10 is electrically connected to the conductor layer 402.

As described above, in the example illustrated in FIG. 7, in the relay section 40B, the first bonding section 404 and the second bonding section 406 are electrically connected by the conductor layer 402. As a result, the external terminal 30 and the winding 14 of the transformer 10 are electrically connected by the relay section 40B. In the example illustrated in FIG. 7, the base 22 is formed integrally with an end portion wall (section holding the external terminal 30) of the case 20. However, in a manner similar to the example illustrated in FIG. 2, the base 22 may be formed separately from the end portion wall of the case 20.

In the transformer device 1B according to the present embodiment, in a manner similar to the above-described transformer device 1A, the winding 14 of the transformer 10 is not directly wound around the external terminal 30 and bonded thereto. Rather, the winding 14 of the transformer 10 is connected to the external terminal 30 with the conducting wire 60 and the relay section 40B therebetween. Therefore, the winding 14 of the transformer 10 may be connected to the relay section 40B in a state in which slack is maintained. Consequently, tension in the winding 14 of the transformer 10 is reduced. As a result, disconnection of the winding 14 of the transformer 10 may be reduced even when the winding 14 of the transformer 10 thermally contracts during the mounting process of the transformer device 1B. In addition, the conducting wire 60 may also be connected to the relay section 40B in a state in which slack is maintained. Consequently, tension in the conducting wire 60 is reduced. Therefore, disconnection of the conducting wire 60 may be reduced even when the conducting wire 60 thermally contracts during the mounting process of the transformer device 1B.

Figure 8A:
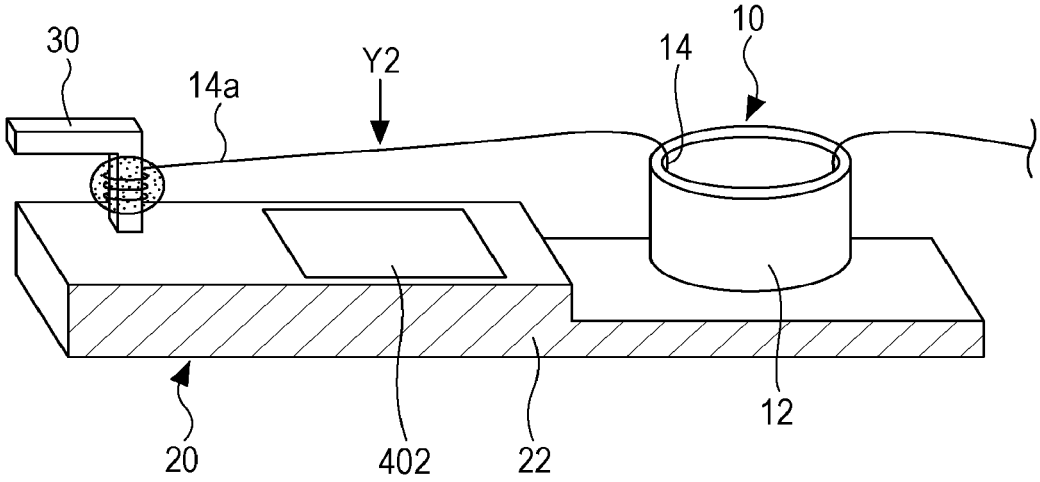
FIGS. 8A and 8B are an explanatory diagram of an example of a method for manufacturing the transformer device 1B.
Figure 8B:
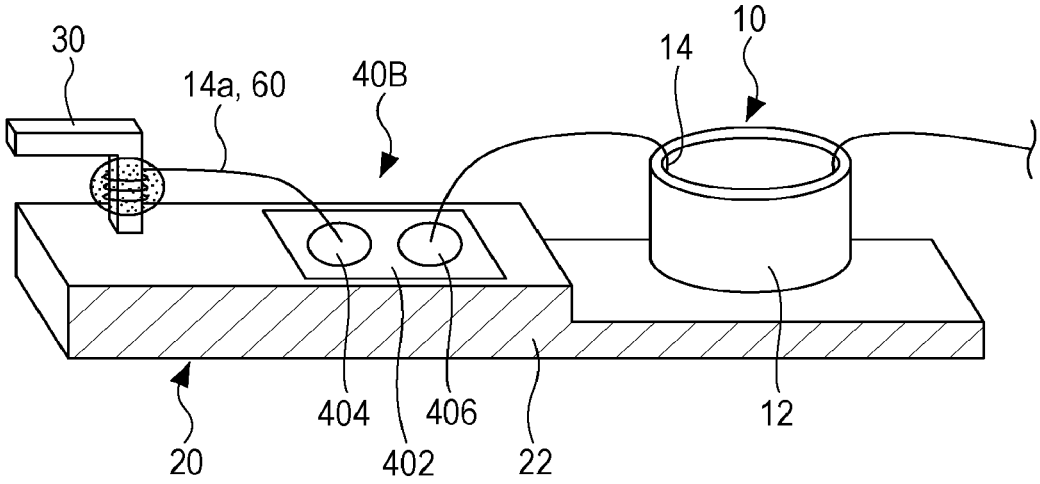

FIGS. 8A and 8B are an explanatory diagram of an example of a method for manufacturing the transformer device 1B, in which a portion of the transformer device 1B is schematically illustrated. The manufacturing method illustrated in FIGS. 8A and 8B is substantially the same as the manufacturing method illustrated in FIGS. 4A to 4C and 5A to 5C. Therefore, differences will mainly be described.

In the present example, in a manner similar to the above-described example illustrated in FIGS. 4A to 4C and 5A to 5C, the case 20 including the external terminal 30 is prepared. The transformer 10 is disposed in a predetermined position within the case 20. The extending portion 14*a* of the winding 14 of the transformer 10 is wound around the external terminal 30 and bonded thereto. In addition, as illustrated in FIG. 8A, the conductor layer 402 is formed on the base 22 of the case 20. The conductor layer 402 may be formed on the case 20 in advance (such as before the transformer 10 is disposed).

Next, the winding 14 of the transformer 10 is severed with the severing point as schematically indicated by Y2 in FIG. 8A, and the extending portion 14*a* of the winding 14 is detached. As a result, the extending portion 14*a* of the winding 14 of the transformer 10 is detached from the winding 14 (main portion) of the transformer 10 and forms the conducting wire 60.

Next, as illustrated in FIG. 8B, the end portion (end portion on the side opposite to the end portion on the side bonded to the external terminal 30) of the conducting wire 60 (extending portion 14*a*) is bonded to the base 22 by an electrically conductive adhesive or a solder, thereby forming the first bonding section 404. In addition, the end portion of the winding 14 of the transformer 10 is bonded to the base 22 by an electrically conductive adhesive or a solder, thereby forming the second bonding section 406. The first bonding section 404 and the second bonding section 406 are formed on the conductor layer 402. As a result, the winding 14 of the transformer 10 and the conducting wire 60 are electrically connected, and the external terminal 30 and the transformer 10 are electrically connected by the relay section 40B.

According to the method for manufacturing the transformer device 1B illustrated in FIGS. 8A and 8B, in a manner similar to the above-described manufacturing method illustrated in FIGS. 4A to 4C and 5A to 5C, the extending portion 14*a* of the winding 14 of the transformer 10 is severed after being wound around the external terminal 30 and bonded. The end portion of the severed extending portion 14*a* and the end portion of the winding 14 of the transformer 10 are individually connected to the relay section 40B. At this time, connection of the end portion of the winding 14 of the transformer 10 to the relay section 40B is actualized by bonding to the base 22 that does not accompany winding. Therefore, the winding 14 of the transformer 10 can be connected to the relay section 40B with suitable surplus length. As a result, tension in the winding 14 of the transformer 10 can be reduced. In addition, in a similar manner, connection of the end portion of the conducting wire 60 (extending portion 14*a*) to the relay section 40B is actualized by bonding to the base 22 that does not accompany winding. Therefore, the conducting wire 60 can be connected to the relay section 40B with suitable surplus length. As a result, tension in the conducting wire 60 can be reduced. Consequently, disconnection of the winding 14 of the transformer 10 and the conducting wire 60 attributed to thermal contraction occurring during the mounting process of the transformer device 1B can be reduced. The respective positions of the first bonding section 404 and the second bonding section 406, and the accompanying length in the width direction W of the conductor layer 402 may be decided based on the surplus lengths that may be desired in the winding 14 of the transformer 10 and the conducting wire 60. In addition, to efficiently obtain the surplus lengths in the winding 14 of the transformer 10 and the conducting wire 60, the position of the base 22 in the height direction H is preferably set to be substantially the same as the position of the winding portion of the conducting wire 60 in the height direction H.

Figure 9A:
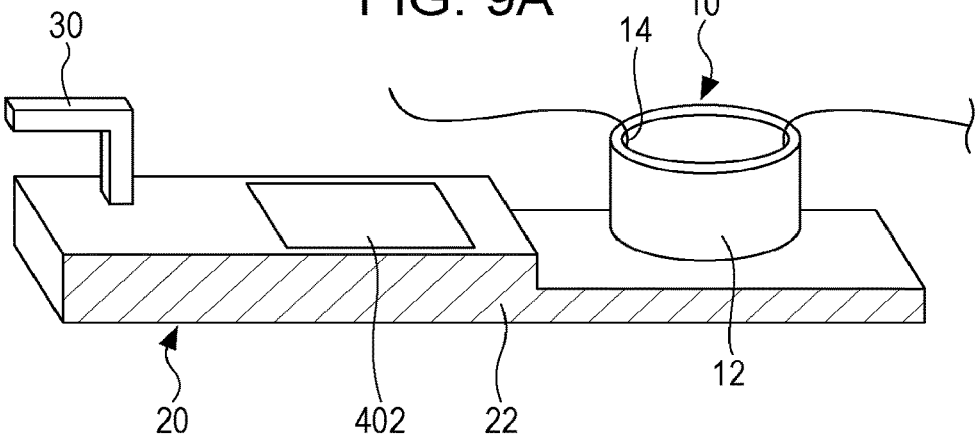
FIGS. 9A to 9C are an explanatory diagram of another example of the method for manufacturing the transformer device 1B.
Figure 9B:
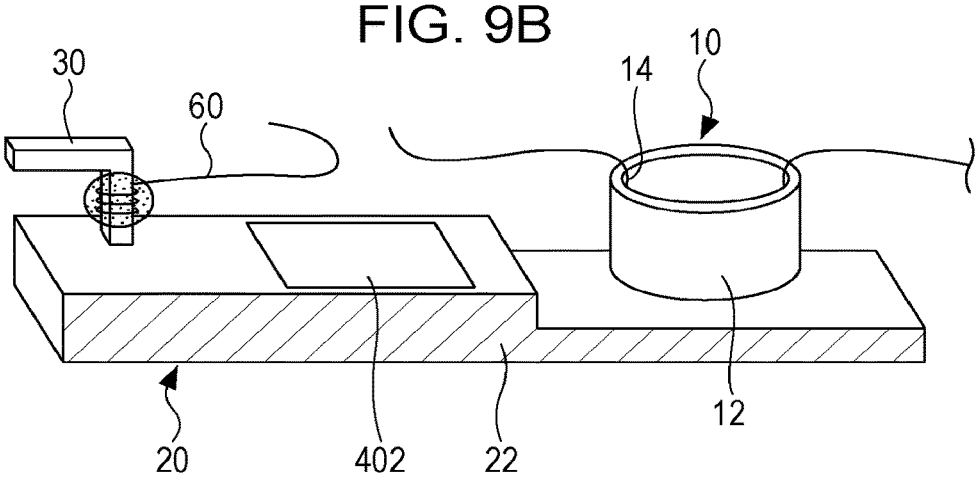
Figure 9C:
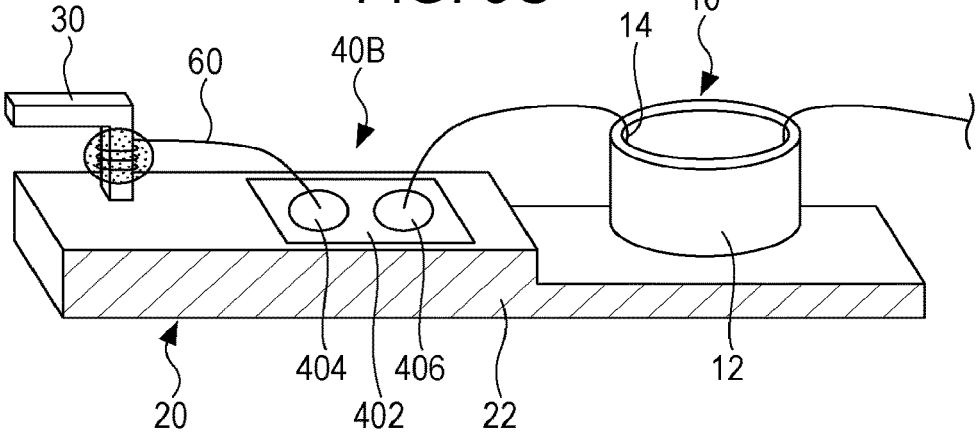

FIGS. 9A to 9C are an explanatory diagram of another example of the method for manufacturing the transformer device 1B, in which a portion of the transformer device 1B is schematically illustrated.

In the present example, in a manner similar to the above-described example illustrated in FIGS. 4A to 4C and 5A to 5C, the case 20 including the external terminal 30 is prepared. As illustrated in FIG. 9A, the transformer 10 is disposed in a predetermined position within the case 20. However, in the present example, the winding 14 of the transformer 10 does not include the extending portion 14*a*. In addition, as illustrated in FIG. 9A, the conductor layer 402 is formed on the base 22 of the case 20. The conductor layer 402 may be formed in the case 20 in advance.

Next, the conducting wire 60 is prepared. As illustrated in FIG. 9B, one end of the conducting wire 60 is wound around the external terminal 30 and bonded thereto. Bonding may be actualized by an electrically conductive adhesive or a solder, as described above.

Next, the other end of the conducting wire 60 is bonded to the conductor layer 402 on the base 22 by an electrically conductive adhesive or a solder. In addition, the end portion of the winding 14 of the transformer 10 is bonded to the conductor layer 402 on the base 22 by an electrically conductive adhesive or a solder. As a result, the first bonding section 404 and the second bonding section 406 of the relay section 40B are formed.

According to the method for manufacturing the transformer device 1B illustrated in FIGS. 9A to 9C, the end portion of the conducting wire 60 and the end portion of the winding 14 of the transformer 10 are individually connected to the conductor layer 402 of the relay section 40B. Therefore, the winding 14 of the transformer 10 may be connected to the relay section 40B with suitable surplus length, and tension in the winding 14 of the transformer 10 may be reduced. In a similar manner, the conducting wire 60 may be connected to the relay section 40B with suitable surplus length, and tension in the conducting wire 60 may be reduced. Consequently, disconnection of the winding 14 of the transformer 10 and the conducting wire 60 attributed to thermal contraction occurring during the mounting process of the transformer device 1B may be reduced.

The method for manufacturing the transformer device 1B illustrated in FIGS. 9A to 9C is capable of more easily ensuring the surplus lengths of the winding 14 of the transformer 10 and the conducting wire 60. Therefore, the position of the base 22 in the height direction H is arbitrary. The base 22 may even be ultimately omitted.

According to the above-described second embodiment, the conducting wire 60 and the winding 14 of the transformer 10 are bonded to the conductor layer 402 of the relay section 40B by the first bonding section 404 and the second bonding section 406. However, the conducting wire 60 and the winding 14 of the transformer 10 may be directly bonded to the conductor layer 402 of the relay section 40B. In other words, the conducting wire 60 and the winding 14 of the transformer 10 may be bonded to the base 22 by the electrically conductive adhesive that forms the conductor layer 402. In this instance, the configuration is substantially the same as that of the above-described transformer device 1A according to the first embodiment.

Figure 10:
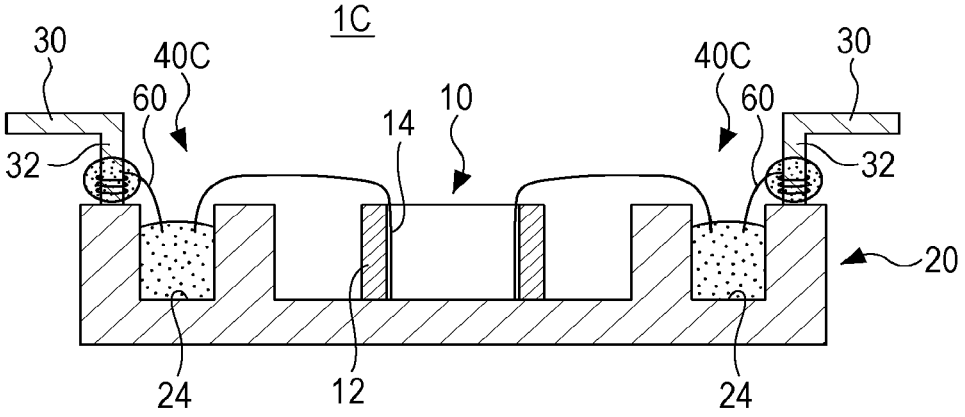
FIG. 10 is a cross-sectional view schematically illustrating a transformer device 1C according to another embodiment (third embodiment).

FIG. 10 is a cross-sectional view schematically illustrating a transformer device 1C according to another embodiment (third embodiment).

In the transformer device 1C, the configuration of a relay section 40C mainly differs from that of the relay section 40 of the above-described transformer device 1A. Hereafter, configurations differing from those of the above-described transformer device 1A will mainly be described. Other configurations may be similar to those of the above-described transformer device 1A.

The relay section 40C is formed within a recessing section 24 formed in the case 20. The relay section 40C may be formed by an electrically conductive adhesive or a solder. In this instance, the relay section 40C is formed by the recessing section 24 being filled with the electrically conductive adhesive or the solder. In an instance in which a plurality of relay sections 40C are set (in other words, when a similar manner of connection is actualized for each of the plurality of external terminals 30), the recessing section 24 may be formed separately for each relay sections 40C.

The third embodiment is suitable in instances in which the relay section 40C is formed by an electrically conductive adhesive that has low viscosity and may take a long period of time to harden. A reason for this is that the electrically conductive adhesive may be kept within the recessing section 24 even when the electrically conductive adhesive that has low viscosity and may take a long period of time to harden is used. In other words, leaking of the electrically conductive adhesive and the like may be suppressed.

In the transformer device 1C according to the present embodiment, in a manner similar to the above-described transformer device 1A, the winding 14 of the transformer 10 is not directly wound around the external terminal 30 and bonded thereto. Rather, the winding 14 of the transformer 10 is connected to the external terminal 30 with the conducting wire 60 and the relay section 40C therebetween. As a result, disconnection of the winding 14 of the transformer 10 and the conducting wire 60 may be reduced even when the winding 14 of the transformer 10 and the conducting wire 60 thermally contract during the mounting process of the transformer device 1C.

In the example illustrated in FIG. 10, a bottom surface of the recessing section 24 is at the same height as the surface of the case 20 on which the transformer 10 is placed. However, this configuration is not a requisite. For example, the recessing section 24 may be formed to be shallower than the depth illustrated in FIG. 10. In addition, the recessing section 24 may be formed on the base 22 as described in the above-described first embodiment.

The transformer device 1C may be manufactured by a method that is substantially the same as the above-described methods for manufacturing the transformer device 1A illustrated in FIGS. 4A to 6C. Therefore, a description of the method for manufacturing the transformer device 1C is omitted. In instances in which the electrically conductive adhesive that has low viscosity and may take a long period of time to harden is used, the recessing portion 24 may be filled with the electrically conductive adhesive at the earliest stage possible (such as before winding and bonding to the external terminal 30).

The embodiments are described in detail above. However, the embodiment is not limited to a specific embodiment, and various modifications and alterations may be made without departing from the scope of claims. In addition, all or a plurality of constituent elements in the above-described embodiments may be combined.

For example, in the above-described embodiments, the transformer device 1A is structured such that the rear side is open and the transformer 10 within the transformer device 1A is exposed (this similarly applies to the transformer devices 1B and 1C). However, the rear side of the transformer device 1A may be sealed by resin molding or the like. In the instance of the structure in which the rear side of the transformer device 1A is open, the relay section 40 is configured such that electrical insulation is ensured in relation to the substrate on which the transformer device 1A is mounted (this similarly applies to the relay sections 40B and 40C). For example, the position of the relay section 40 in the height direction H may be set further towards the front side than the portion of the external terminal 30 that is connected to the substrate, such that distance that may be desired between the relay section 40 and the substrate (distance in the direction perpendicular to the surface of the substrate) is ensured (this similarly applies to the relay sections 40B and 40C; the same applies hereafter). In a similar manner, in an instance in which the winding 14 of the transformer 10 and the conducting wire 60 are connected to the relay section 40 so as to have slack as described above, the relay section 40 is configured such that the winding 14 of the transformer 10 and the conducting wire 60 are not electrically connected to the substrate in an unintentional manner as a result of the slack.

In addition, in the above-described embodiments, a solder is used as an example of a brazing material. However, various types of solder may be used as the solder, regardless of the type of metal (such as tin) contained as a main ingredient. In addition, other brazing materials may be used instead of the solder. For example, the brazing material may contain gold, silver, copper, or the like. In addition, the brazing material may be hard or soft solder. Furthermore, the brazing material is not limited to a material composed of an alloy. Any type of electrically conductive material that actualizes bonding by becoming liquefied by heating and hardened by cooling (including natural cooling) may be used as the brazing material.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A method for manufacturing a transformer device, the method comprising:

disposing a transformer that includes a magnetic body core and a winding within a case;

winding an extending portion of the winding of the transformer around an external terminal that is provided in the case, and bonding the extending portion thereto;

severing the extending portion and detaching the extending portion from the winding of the transformer;

connecting an end portion of the extending portion on a side of the extending portion opposite to a side of the extending portion that is bonded to the external terminal to a relay section that is provided in the case; and connecting an end portion of the winding of the transformer from which the extending portion has been detached to the relay section.

2. A method for manufacturing a transformer device, the method comprising:

disposing a transformer that includes a magnetic body core and a winding within a case which has a pillar shaped relay section:

connecting one end of a conducting wire to an external terminal provided on the case by winding the conducting wire around the external terminal:

bonding another end of the conducting wire to a top of the pillar shaped relay section; and bonding an end portion of the winding of the transformer to the top of the pillar shaped relay section.

3. The method according to claim 2, further comprising covering the one end of the conductive wire wound to the external terminal with a conductive material.

4. The method according to claim 2, wherein the disposing includes disposing the transformer such that the pillar shaped relay section is positioned between the external terminal and the transformer.

* * * * *